US011248864B2

(12) United States Patent
Kellgren

(10) Patent No.: US 11,248,864 B2
(45) Date of Patent: Feb. 15, 2022

(54) COMPACT FIREARM

(71) Applicant: Kel-Tec CNC Industries Inc., Cocoa, FL (US)

(72) Inventor: George Kellgren, Cocoa, FL (US)

(73) Assignee: KEL-TEC CNC INDUSTRIES, INC., Cocoa, FL (US)

( * ) Notice: Subject to any disclaimer, the term of this patent is extended or adjusted under 35 U.S.C. 154(b) by 0 days.

(21) Appl. No.: 16/842,685

(22) Filed: Apr. 7, 2020

(65) Prior Publication Data

US 2021/0310758 A1 Oct. 7, 2021

(51) Int. Cl.
*F41A 9/17* (2006.01)
*F41A 9/45* (2006.01)

(52) U.S. Cl.
CPC . *F41A 9/17* (2013.01); *F41A 9/45* (2013.01)

(58) Field of Classification Search
CPC ..... F41A 9/12; F41A 9/17; F41A 9/19; F41A 9/45
USPC ..... 42/6
See application file for complete search history.

(56) References Cited

U.S. PATENT DOCUMENTS 2,624,241 A 1/1953 Hill
2,856,716 A * 10/1958 Compton ..... F41A 9/25 42/39.5
3,088,378 A * 5/1963 Boudreau ..... F41G 1/16 89/161
3,167,876 A * 2/1965 Milroy, Jr. ..... F41A 9/68 42/7
4,336,742 A 6/1982 Bourlet
4,905,394 A 3/1990 Predazzer
5,235,769 A * 8/1993 Stead ..... F41A 9/17 42/11
5,367,810 A * 11/1994 Stead ..... F41A 9/72 42/17
5,610,362 A * 3/1997 Bouvard ..... F41A 9/45 42/39.5
5,939,657 A * 8/1999 Morgado ..... F42B 5/02 89/33.03
2005/0223884 A1 * 10/2005 Alexandrovich ..... F41A 9/45 89/5

(Continued)

OTHER PUBLICATIONS

FN America, LLC, "FN P90(R)," https://fnamerica.com/products/rifles/fn-p90/, (c) 2020, Accessed Mar. 10, 2020.

*Primary Examiner* — Bret Hayes
(74) *Attorney, Agent, or Firm* — Bennet K. Langlotz; Langlotz Patent & Trademark Works, LLC

(57) ABSTRACT

Firearms have a lower frame including a trigger and a grip, an upper frame including a barrel and a bolt, and a magazine receptacle configured to receive a magazine and positioned between the upper and lower frames. The lower frame and upper frame may each have forward portions pivotally connected to each other to form a pivotal connection. The pivotal connection may be operable to pivot on a horizontal axis transverse to the firearm. The upper and lower frames may be movable between an open position in which the upper and lower frame are angularly separated from each other and the magazine receptacle is accessible for removal and replacement of a magazine, and a closed position in which the magazine is closely received between the upper and lower frames. The magazine receptacle may be laterally open on both sides of the firearm.

23 Claims, 16 Drawing Sheets

(56) References Cited

U.S. PATENT DOCUMENTS

2017/0299296 A1* 10/2017 DeeS ..... F41A 11/00
2020/0041221 A1* 2/2020 Mesco ..... F41A 9/59

* cited by examiner

COMPACT FIREARM

FIELD OF THE INVENTION

The present invention relates to firearms, and more particularly to a firearm that has an elongated magazine parallel to the barrel.

BACKGROUND OF THE INVENTION

Horizontal magazines are employed in compact rifles to provide a large ammunition capacity without a substantial protrusion below the firearm. An example is the Fabrique Nationale (Herstal, Belgium) P-90 firearm, which has a 50-round magazine positioned atop the frame above and parallel to the barrel. While useful, this example is bulkier than is sometimes desired for more compact or concealable firearms, with a buttstock extending well to the rear of the installed magazine and containing essential trigger mechanism componentry, Further, the positioning of the magazine above the barrel creates added vertical bulk, and elevates sights or an aiming optic farther above the barrel axis than is desirable.

Therefore, a need exists for a new and improved firearm that incorporates a horizontal magazine in a more compact configuration. In this regard, the various embodiments of the present invention substantially fulfill at least some of these needs. In this respect, the firearm according to the present invention substantially departs from the conventional concepts and designs of the prior art, and in doing so provides an apparatus primarily developed for the purpose of providing a firearm with a magazine receptacle configured to receive a horizontal magazine positioned between the upper and lower frames to form a pistol-like firearm.

SUMMARY OF THE INVENTION

The present invention provides an improved firearm, and overcomes the above-mentioned disadvantages and drawbacks of the prior art. As such, the general purpose of the present invention, which will be described subsequently in greater detail, is to provide an improved firearm that has all the advantages of the prior art mentioned above.

To attain this, the preferred embodiment of the present invention essentially comprises a lower frame including a trigger and a grip, an upper frame including a barrel and a bolt, and a magazine receptacle configured to receive a magazine and positioned between the upper and lower frames. The lower frame and upper frame may each have forward portions pivotally connected to each other to form a pivotal connection. The pivotal connection may be operable to pivot on a horizontal axis transverse to the firearm. The upper and lower frames may be movable between an open position in which the upper and lower frame are angularly separated from each other and the magazine receptacle is accessible for removal and replacement of a magazine, and a closed position in which the magazine is closely received between the upper and lower frames. The magazine receptacle may be laterally open on both sides of the firearm, such that a major portion of lateral edges of the magazine is exposed when the frames are in the closed position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
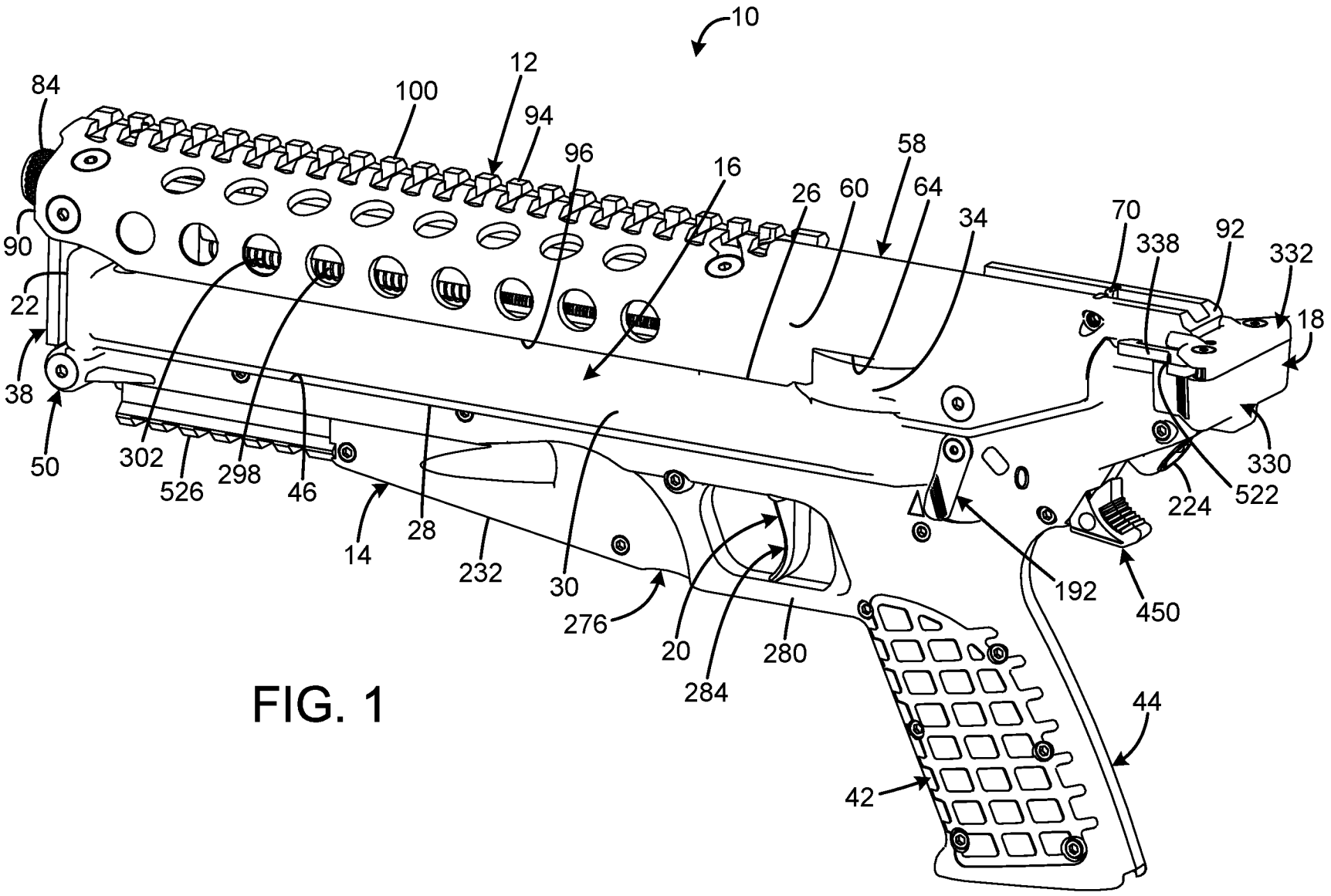
FIG. 1 is a top isometric view of the current embodiment of a firearm constructed in accordance with the principles of the present invention in the closed position.

An embodiment of the firearm of the present invention is shown and generally designated by the reference numeral 10.

Figure 2:
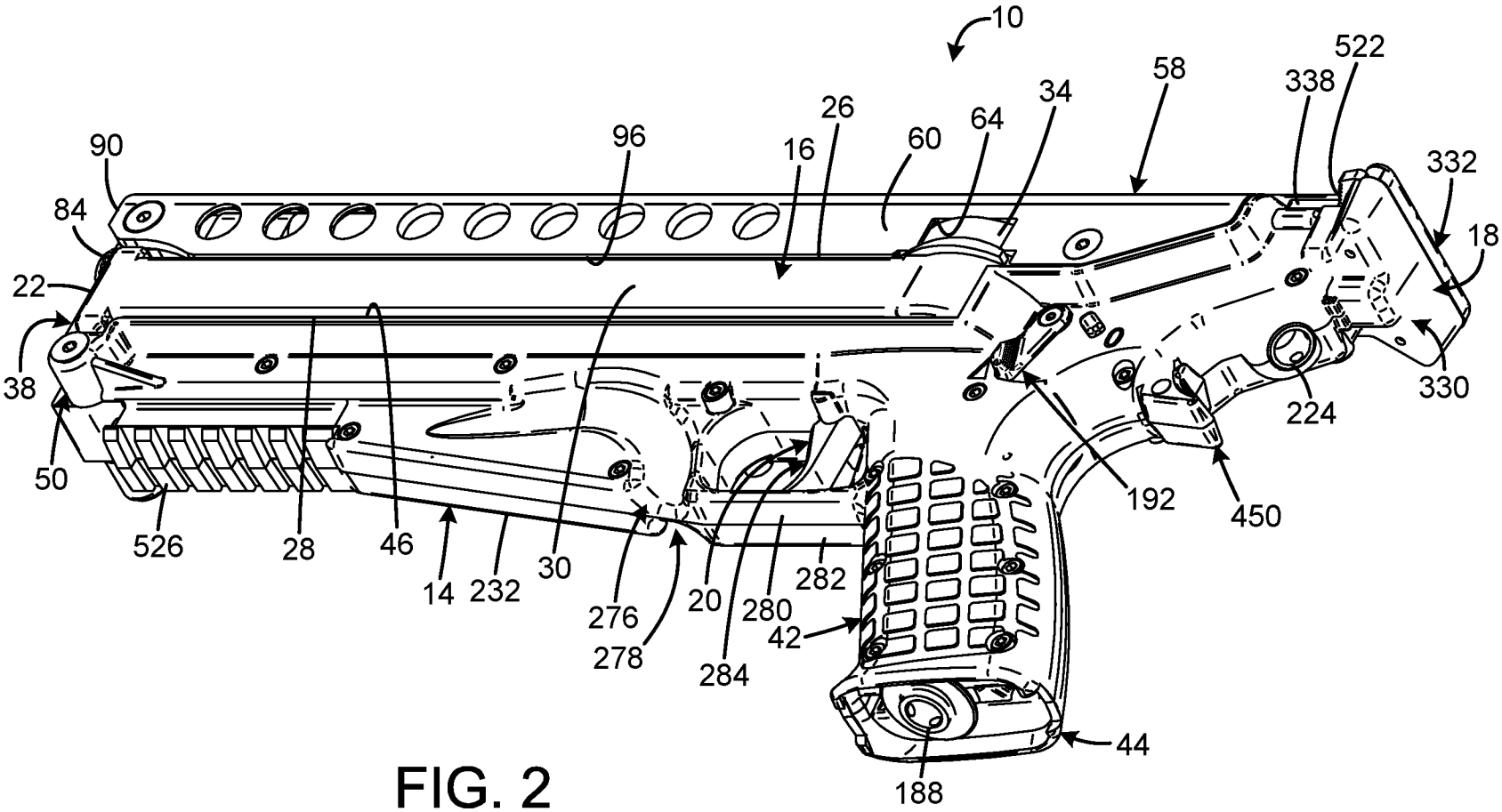
FIG. 2 is a bottom isometric view of the firearm of FIG. 1 in the closed position.
Figure 3:
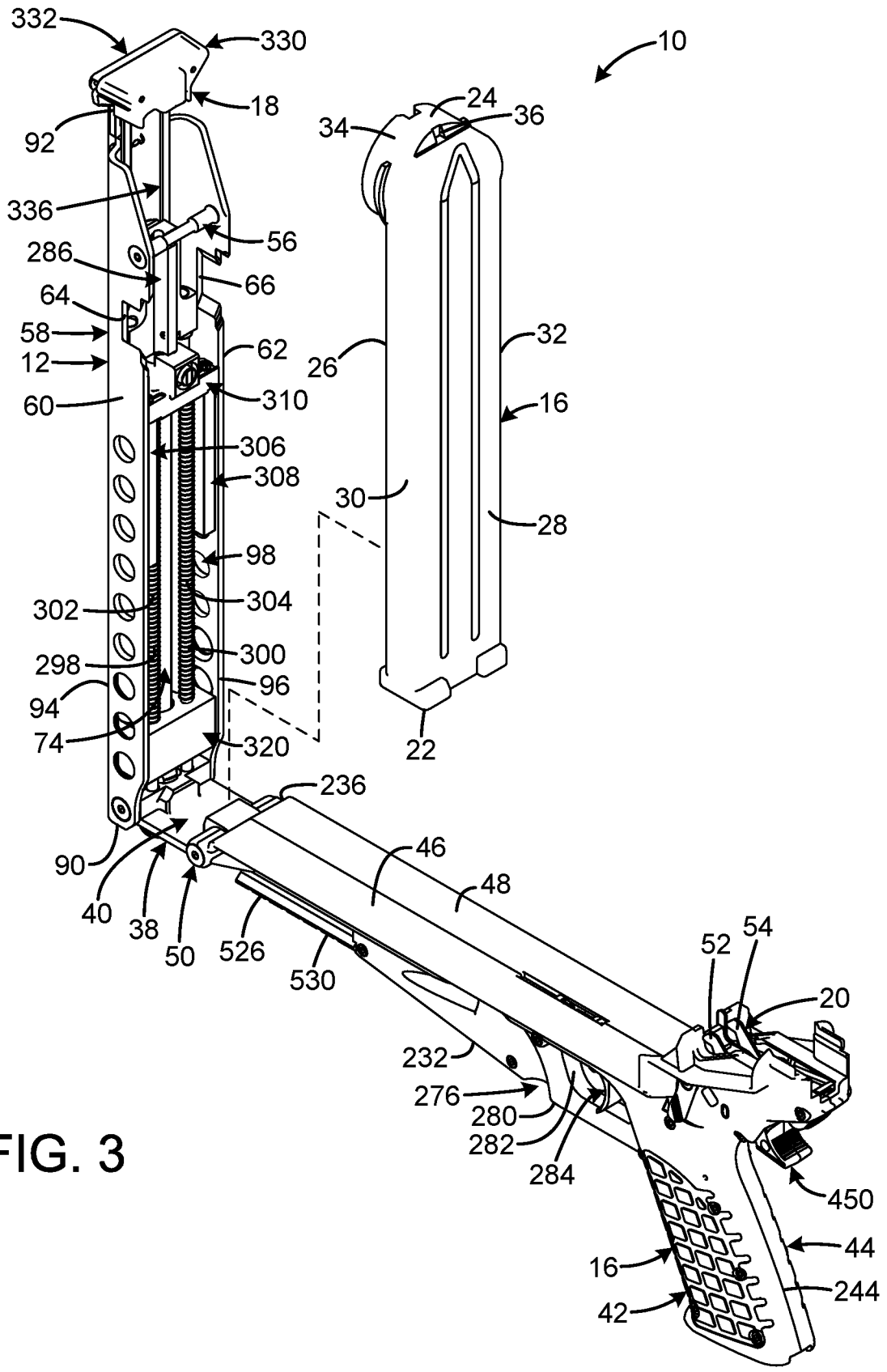
FIG. 3 is a top isometric view of the firearm of FIG. 1 in the open position.

FIGS. 1-3 illustrate the improved firearm 10 of the present invention. More particularly, FIGS. 1 and 2 show the firearm in the closed condition, and FIG. 3 shows the firearm in the open position. The firearm has a receiver assembly 12 and a grip assembly 14 that receive a horizontal magazine 16 between them to form a pistol-like firearm. The receiver assembly receives a bolt assembly 18, and the grip assembly receives a trigger assembly 20.

The magazine 16 is the top mounted longitudinal magazine disclosed in U.S. Pat. No. 4,905,394 to Predazzer. The magazine was developed for the FN P90® selective fire carbine in the late 1980s by FN Herstal of Belgium. The magazine is a detachable polymer magazine having a 50-round capacity. Although the FN P90® has been commercially successful, the FN P90® is significantly longer than the magazine, resulting in additional bulk and weight.

By comparison, the current invention is far more pistol-like and extends only minimally forward and rearward of the magazine. The magazine has a front 22, rear 24, top 26, bottom 28, left side 30, and right side 32. The top rear of the magazine has a circular feeder 34 that defines the maximum width of the magazine. The rear of the magazine also defines a latching notch 36.

The firearm 10 has an open position and a closed position. In the open position shown in FIG. 3, muzzle block 38 defines a magazine receptacle 40 that closely receives the front 22 of the magazine 16 to position the magazine vertically. The magazine can also be positioned horizontally while the firearm is in the open position by laying the bottom 28 of the magazine on the tops 46, 48 of the left grip 42 and right grip 44. The firearm pivots between the open position and the closed position about hinge 50. The firearm is secured in the closed position by the engagement of left and right release catches 52, 54 with receiver release bar 56. The left and right sides 60, 62 of a receiver 58 portion of the receiver assembly 12 define left and right magazine cutouts 64, 66 immediately forward of the receiver release bar to accommodate the additional width of the circular feeder 34 of the magazine.

Figure 4:
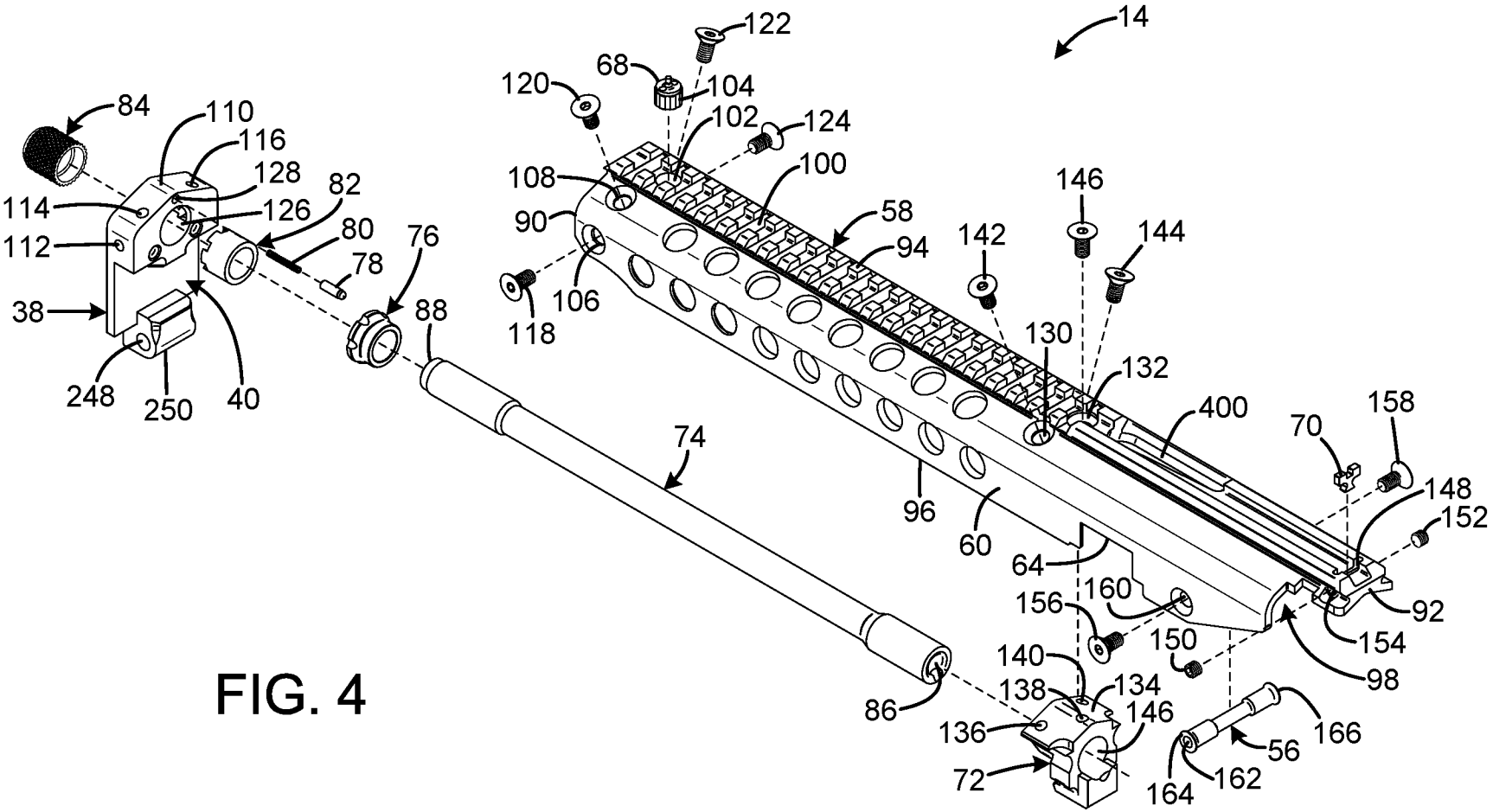
FIG. 4 is an exploded view of the receiver assembly of the firearm of FIG. 1.

FIG. 4 illustrates the receiver assembly 14 of the improved firearm 10 of the present invention. More particularly, the receiver assembly has a magazine block 38, receiver release bar 56, receiver 58, front sight post 68, rear sight 70, trunnion 72, barrel 74, barrel nut 76, front sight detent 78, front sight detent spring 80, headspace ring 82, and barrel thread protector 84. The rear of the barrel defines a chamber 86, and the front of the barrel defines a muzzle 88. The receiver has a front 90, rear 92, top 94, bottom 96, and defines an interior 98. The top front of the receiver forms an accessory rail 100 and defines a front sight post aperture 102 that receives the front sight post. The accessory rail enables an accessory such as optics (not shown) to be attached to the firearm 10. The front sight post defines exterior ridges 104 that interact with the front sight detent and front sight detent spring to produce a clicking noise and sensation when the front sight post is rotated within the front sight post aperture. The front sight detent spring and the rear portion of the front sight detent are received in bore 128 of the muzzle block. The top front and left and right sides define four apertures (apertures 106 and 108 are visible) that are axially registered with four apertures in the top 110 of the muzzle block (apertures 112, 114, 116 are visible) so that screws 118, 120, 122, 124 can secure the muzzle block within the front interior of the receiver. The muzzle block defines a central aperture 126 that receives the muzzle of the barrel. The barrel nut and headspace ring prevent longitudinal movement of the muzzle of the barrel. The barrel thread protector protects the threads on the muzzle of the barrel from damage when an accessory such as a flash hider or suppressor is not installed.

The top 94 of the receiver 58 where the rear of the accessory rail 100 terminates defines three apertures (apertures 130, 132 are visible) that are axially registered with three apertures 136, 138, 140 in the top 134 of the trunnion 72 so that screws 142, 144, 146 can secure the trunnion within the interior 98 of the receiver. The trunnion defines a central aperture 146 that receives the chamber of the barrel. Thus, the muzzle block 38 and trunnion 72 work together to retain the barrel within the interior of the receiver in a fixed position. The rear sight 70 is secured within a slot 148 defined by the top rear 92 of the receiver by left and right socket head capture screws 150, 152 received in apertures communicating with the slot (aperture 154 is visible). The receiver release bar 56 is secured within the rear interior of the receiver by screws 156, 158 received in two apertures (aperture 160 is visible) axially registered with threaded openings (opening 162 is visible) in the left and right opposed ends 164, 166 of the receiver release bar.

Figure 5:
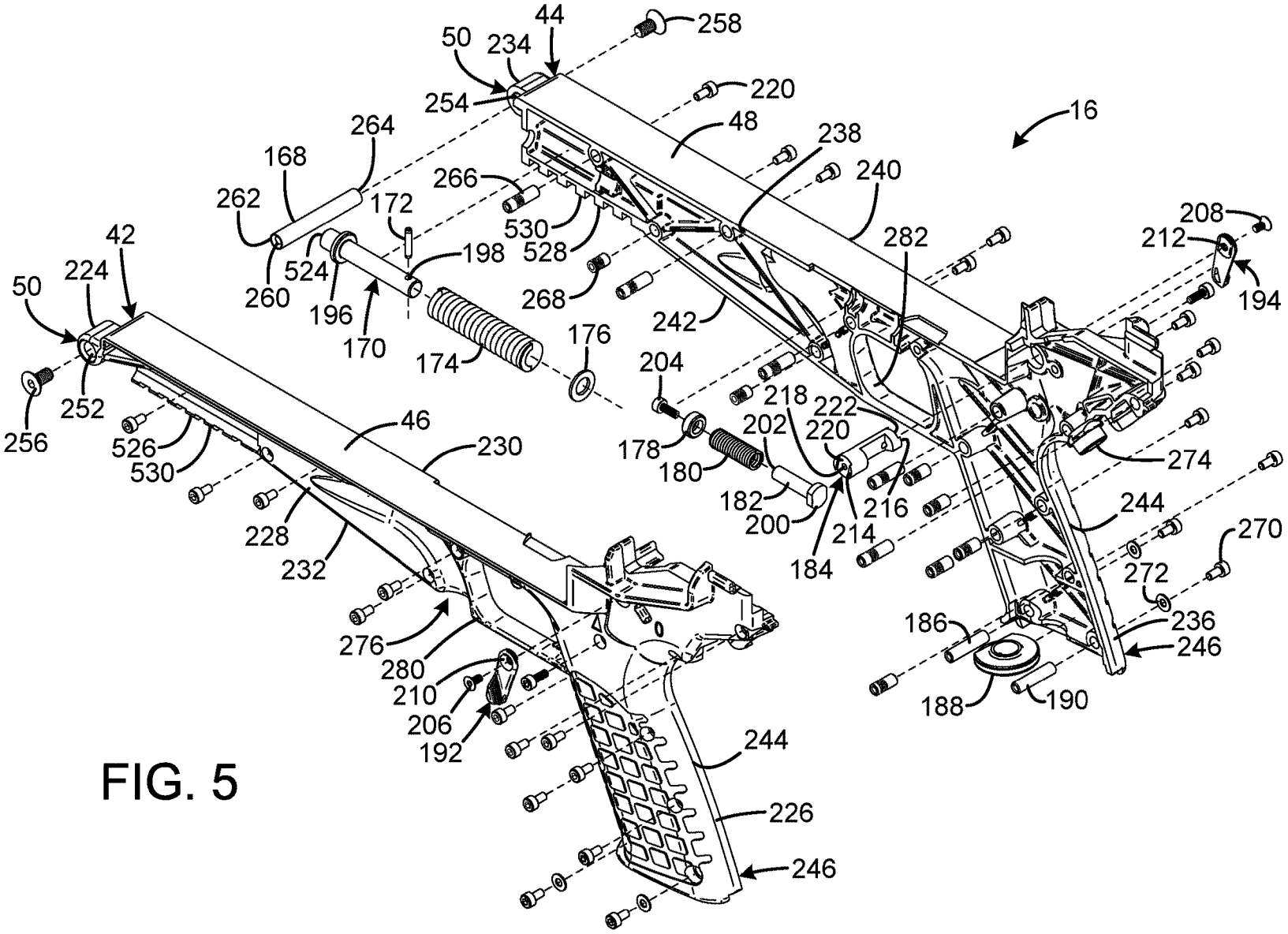
FIG. 5 is an exploded view of the grip assembly of the firearm of FIG. 1.

FIG. 5 illustrates the grip assembly 16 of the improved firearm 10 of the present invention. More particularly, the grip assembly has a left grip 42, right grip 44, hinge axle 168, buffer shaft 170, slotted spring pin 172, buffer spring 174, buffer washer 176, trigger stop retainer 178, trigger stop spring 180, trigger stop 182, safety 184, front standoff 186, bottom quick detach connector 188, rear standoff 190, left safety lever 192, and right safety lever 194. The buffer shaft has a forward flange portion 196 and defines a top rear bore 198 that receives the slotted spring pin to capture the buffer spring and buffer washer on the buffer shaft between the forward flange portion and the slotted spring pin. The trigger stop captures the trigger stop spring between a head portion 200 and the trigger stop retainer, which is threadedly secured to the forward end 202 of the trigger stop by a screw 204. The trigger stop cushions and limits forward movement of the trigger 284 after the firearm 10 is discharged. The left and right safety levers are threadedly secured by screws 206, 208 that pass through apertures 210, 212 and threadedly engage apertures in the left and right opposed ends 214, 216 of the safety (aperture 218 is visible). The left and right opposed ends of the safety define slots 220, 222 that receive portions of the left and right safety levers so that the left and right safety levers can be used to rotate the safety.

The left grip 42 has a front 224, rear 226, left side 228, right side 230, and bottom 232. The right grip 44 has a front 234, rear 236, left side 238, right side 240, and bottom 242. The rear of the left grip and the rear of the right grip form a pistol grip 244. The left grip and the right grip are two halves of a lower frame 246. The hinge axle 168 passes through an aperture 248 in the bottom 250 of the muzzle block 38 (shown in FIG. 4), is received in apertures 252, 254 defined by the fronts of the left and right grips, and is threadedly secured by screws 256, 258 that engage threaded apertures (aperture 260 is visible) in the opposed left and right ends 262, 264 of the hinge axle to form hinge 50. The left grip and right grip are secured together by a plurality of threaded inserts 266, 268 of varying sizes and a plurality of screws 270 axially registered with a plurality of apertures in the left grip and right grip. The screws 270 securing the front and rear standoffs utilizing additional apertures in the left grip and right grip also have washers 272. A bottom quick detach connector 188 and a top quick detach connector 274 can be used to detachably connect a sling (not shown) to the firearm 10. The bottoms of the left and right grip form left and right front grip channels 276, 278 (right front grip channel 278 is visible in FIG. 2) that receive an optional folding front grip (not shown). The bottoms of the left and right grip also form left and right trigger guard halves 280, 282 to protect trigger 284. The front portions of the bottoms of the left and right grips 526, 528 form an accessory rail 530 for attaching accessories like a light (not shown) to the firearm 10.

Figure 6:
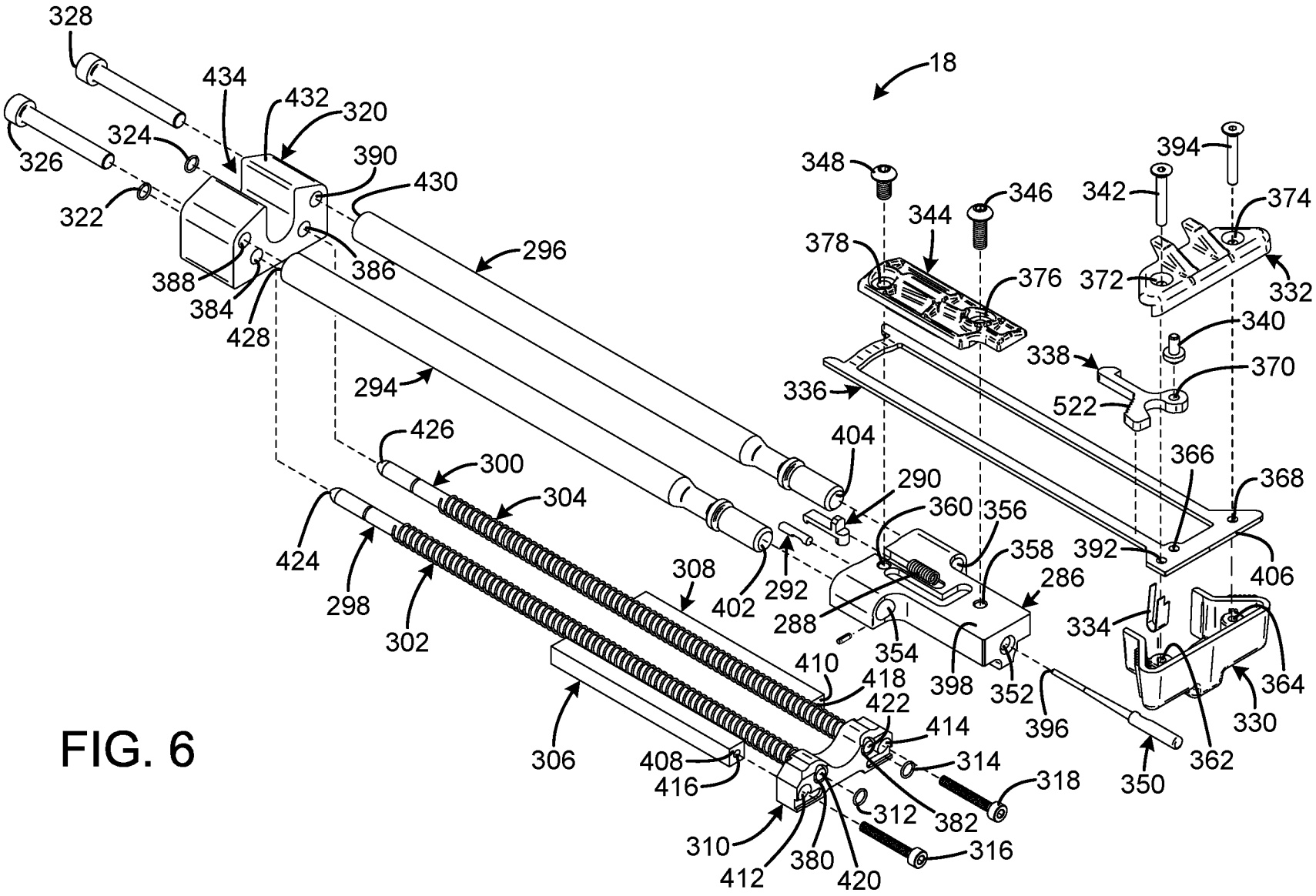
FIG. 6 is an exploded view of the bolt assembly of the firearm of FIG. 1.

FIG. 6 illustrates the bolt assembly 18 of the improved firearm 10 of the present invention. More particularly, the bolt assembly has a bolt 286, extractor spring 288, extractor 290, ejector 292, left and right bolt rods 294, 296, left and right recoil spring guide rods 298, 300, left and right recoil springs 302, 304, left and right recoil buffers 306, 308, recoil spring block 310, left and right retaining rings 312, 314, bolts 316, 318, bolt rod mount 320, retaining rings 322, 324, bolts 326, 328, operating handle 330, operating handle cap 332, latch spring 334, operating handle frame 336, operating handle latch 338, latch bushing 340, bolts 342, 394, bolt cover 344, screw 346, screw 348, and firing pin 350. The bolt defines a rear bore 352 that receives the forward portion 396 of the firing pin. The top 398 of the bolt also defines apertures 358 and 360 that are axially registered with apertures 376 and 378 in the bolt cover so that screws 346 and 348 can threadedly secure the bolt cover to the top of the bolt. The extractor functions to withdraw a spent cartridge (not shown) from the chamber 86 of the barrel 74. The ejector subsequently functions to eject the spent cartridge through the ejection port 400 in the top 94 of the receiver 58. Left and right apertures 354, 356 on either side of the bolt receive the rears 402, 404 of the left and right bolt rods. Bolts 342, 394 pass through apertures 372, 374 on either side of the operating handle cap, apertures 392, 368 in the rear 406 of the operating handle frame, and are threadedly received in apertures 362, 364 in either side of the operating handle to secure the operating handle cap to the operating handle. The operating handle latch is secured to the rear of the operating handle frame by the latch bushing, which is received in aperture 366 in the rear of the operating handle frame and aperture 370 in the operating handle latch. The rears 408, 410 of the left and right recoil buffers are threadedly secured to the recoil spring block by bolts 316, 318 that are received in apertures 412, 414 in either side of the recoil spring block and apertures 416, 418 in the rears of the left and right recoil buffers. The rears 420, 422 of the left and right recoil spring guide rods are secured in apertures 380, 382 in either side of the recoil spring block by the retaining rings 312, 314. The front ends 424, 426 are secured in apertures 384, 386 of the bolt rod mount by retaining rings 322, 324. The left and right recoil springs are captured on the left and right recoil spring guide rods between the bolt rod mount and the recoil spring block. The fronts 428, 430 of the left and right bolt rods are threadedly secured to the bolt rod mount by bolts 326, 328 that are received in apertures 388, 390 in either side of the bolt rod mount. The top 432 of the bolt rod mount defines a central channel 434 to provide clearance for the muzzle 88 of the barrel 74.

Figure 7:
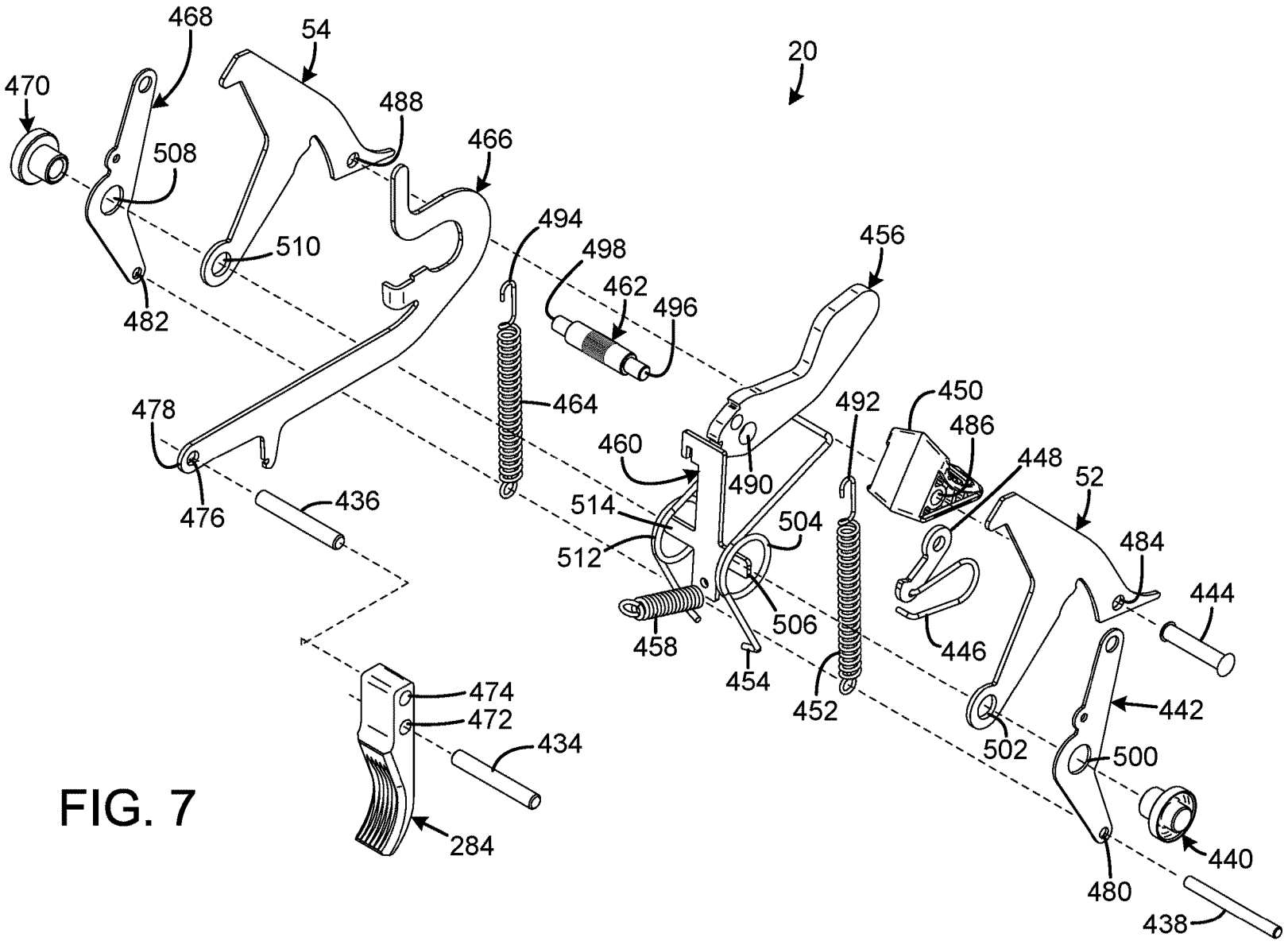
FIG. 7 is an exploded view of the trigger assembly of the firearm of FIG. 1.

FIG. 7 illustrates the trigger assembly 20 of the improved firearm 10 of the present invention. More particularly, the trigger assembly has a trigger 284, dowel pin 434, dowel pin 436, dowel pin 438, left release spring bushing 440, left support plate 442, release rivet 444, left release catch 52, safety snap spring 446, safety snap 448, assembly button 450, left hammer spring 452, release spring 454, hammer 456, trigger spring 458, sear 460, hammer spring axle 462, right hammer spring 464, trigger bar 466, right release catch 54, right support plate 468, and right release spring bushing 470. Dowel pin 434 is received in aperture 472 of the trigger. Dowel pin 436 is received in aperture 474 of the trigger and aperture 476 in the front 478 of the trigger bar. Dowel pin 438 is received in aperture 480 of the left support plate and aperture 482 of the right support plate. Release rivet 444 is received in aperture 484 of the left release catch, aperture 486 of the assembly button, and aperture 488 of the right release catch. The hammer is pivotally mounted on the hammer spring axle via aperture 490, and the tops 492, 494 are hooked over the opposed left and right ends 496, 498 of the hammer spring axle. The left release spring bushing passes through aperture 500 of the left support plate, aperture 502 of the left release catch, and loop 504 of the release spring to attach the left support plate and left release catch to left protrusion 506 on the sear. The right release spring bushing passes through aperture 508 of the right support plate, aperture 510 of the right release catch, and loop 512 of the release spring to attach the right support plate and right release catch to the right protrusion 514 on the sear. The trigger spring biases the trigger to a forward, at rest position. A spring 446 loaded lever 448 actuates detents in the safety 220.

Figure 8:
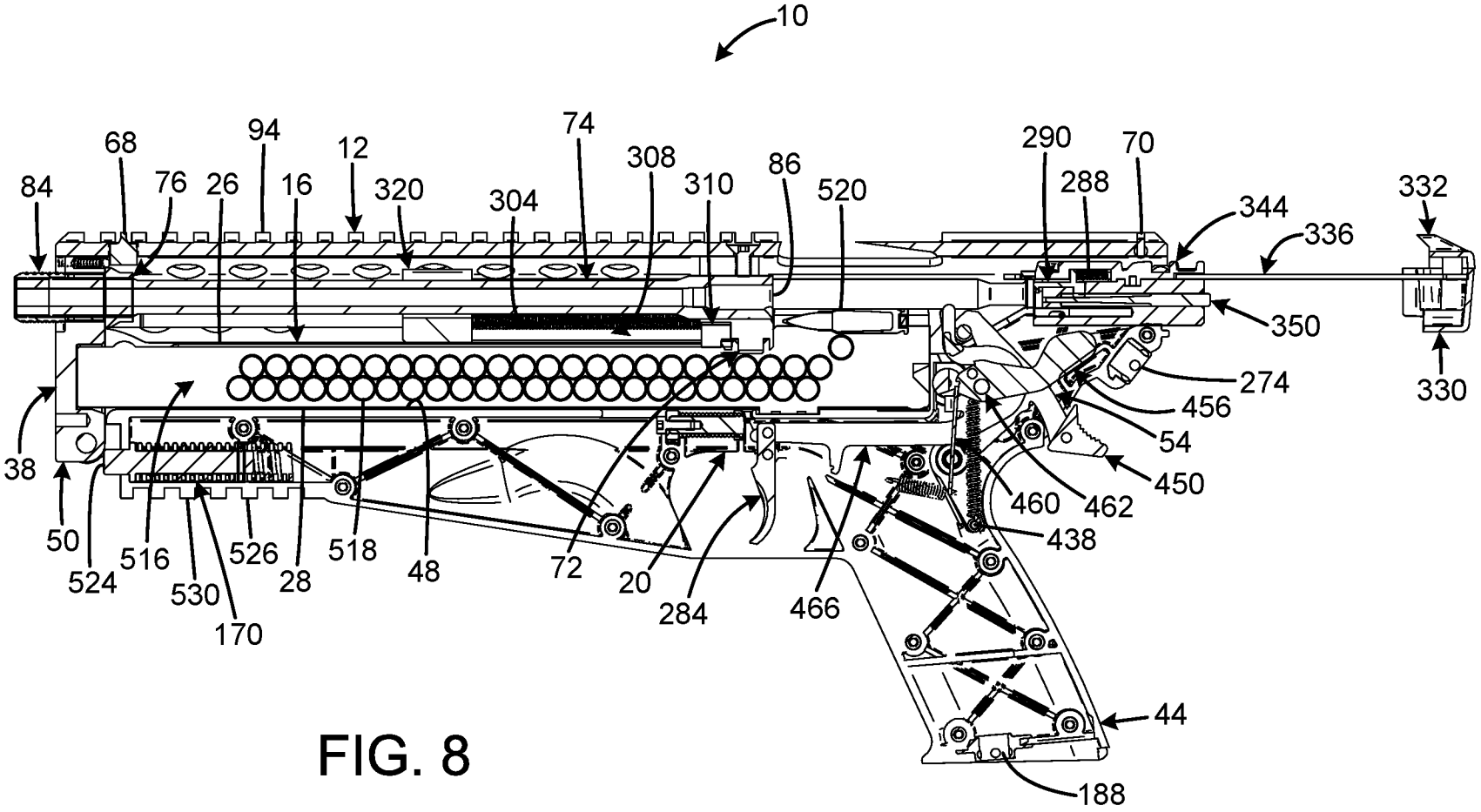
FIG. 8 is a side sectional view of the firearm of FIG. 1 in the full recoil condition.
Figure 9:
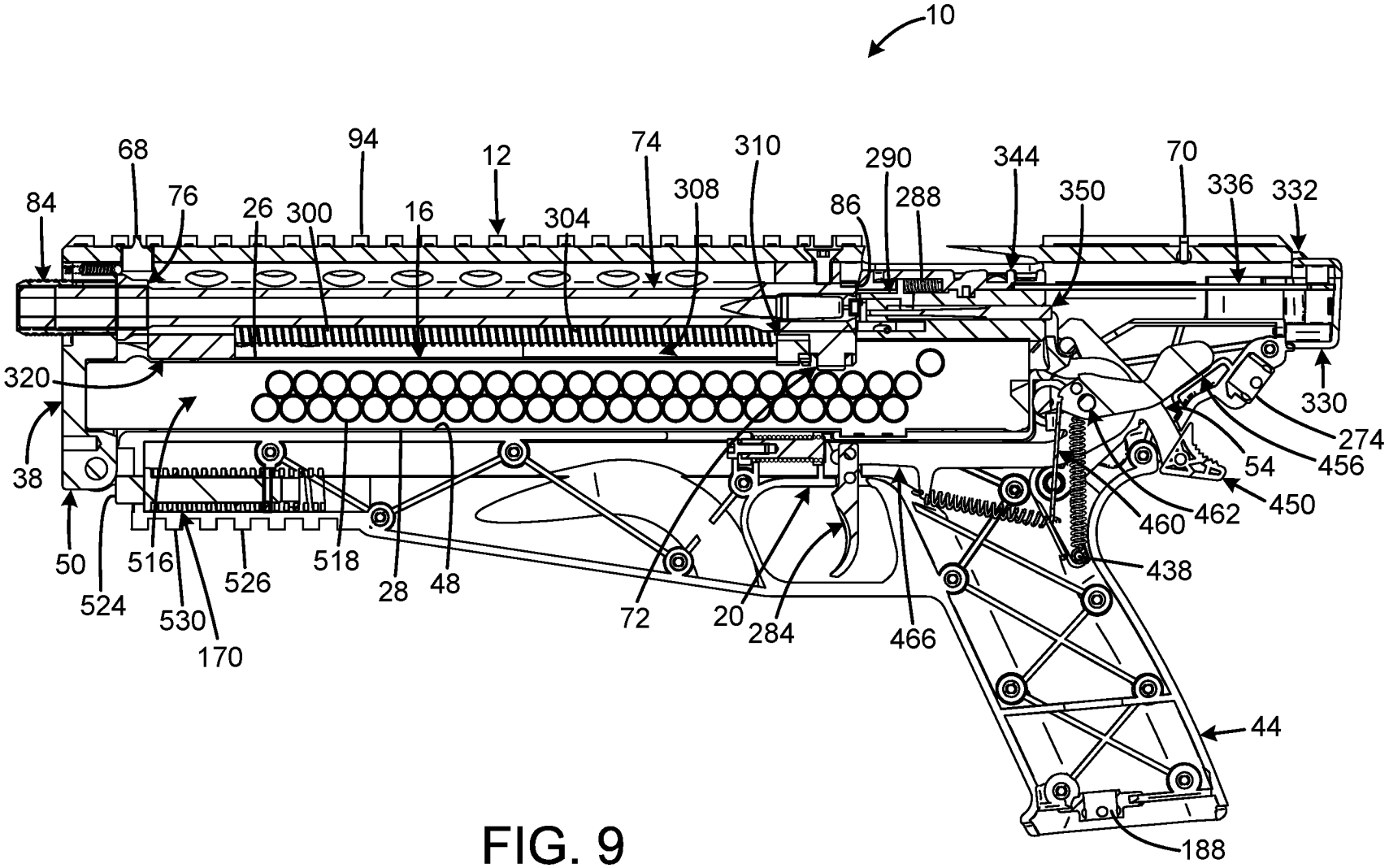
FIG. 9 is a side sectional view of the firearm of FIG. 1 in the battery condition.
Figure 10:
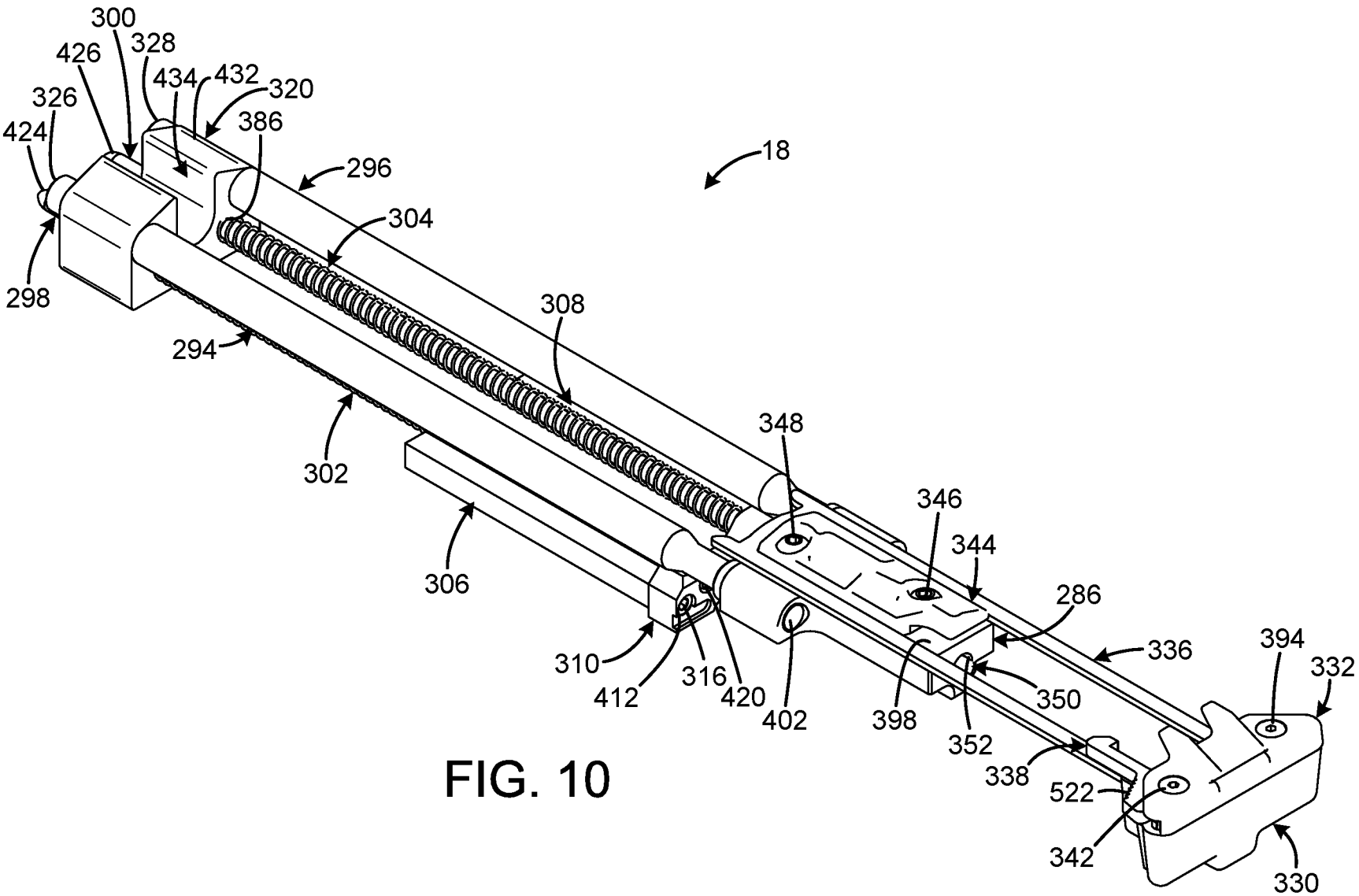
FIG. 10 is a top isometric view of the bolt assembly of the firearm of FIG. 1 in the full recoil condition.
Figure 11:
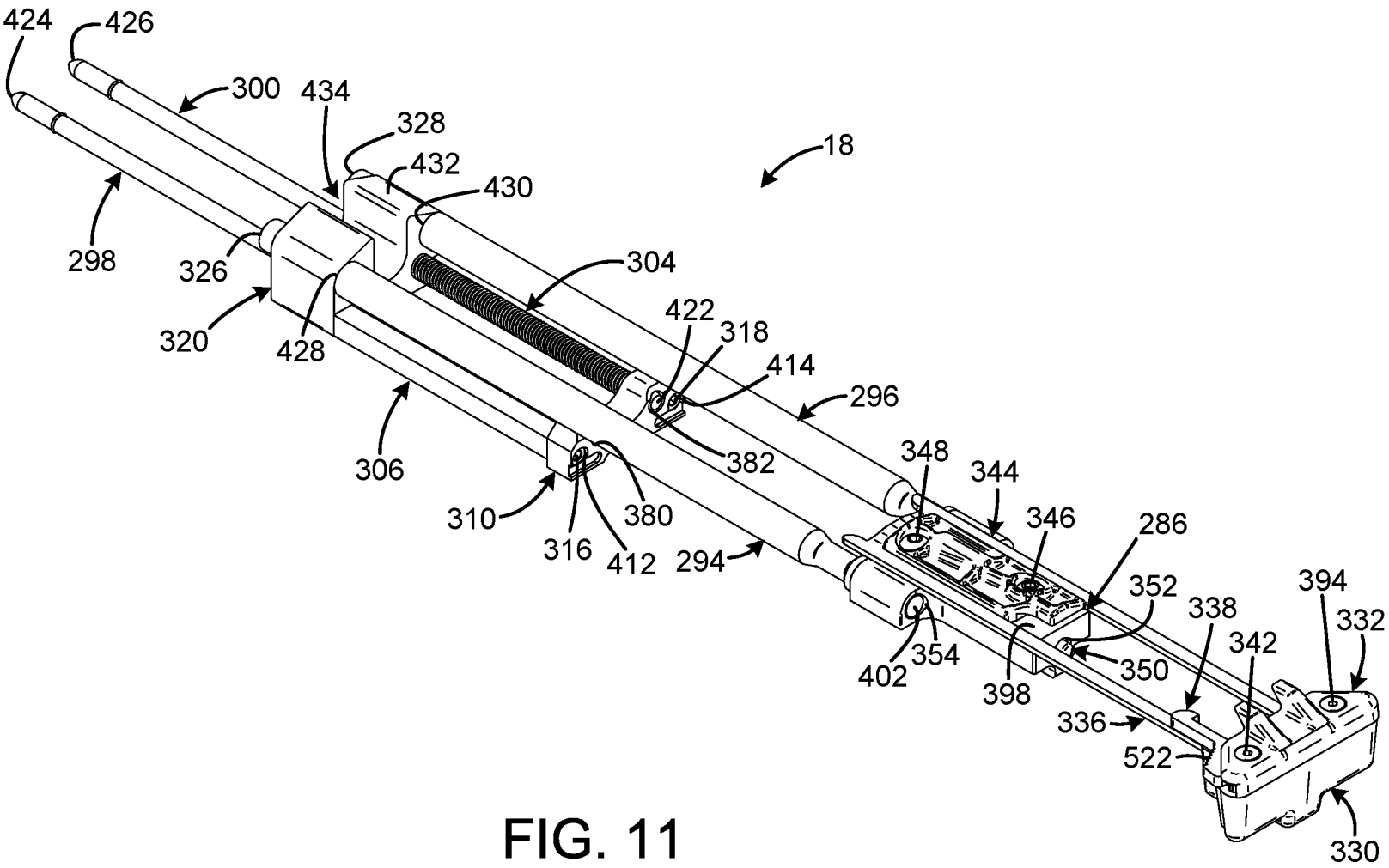
FIG. 11 is a top isometric view of the bolt assembly of the firearm of FIG. 1 in the battery condition.
Figure 12:
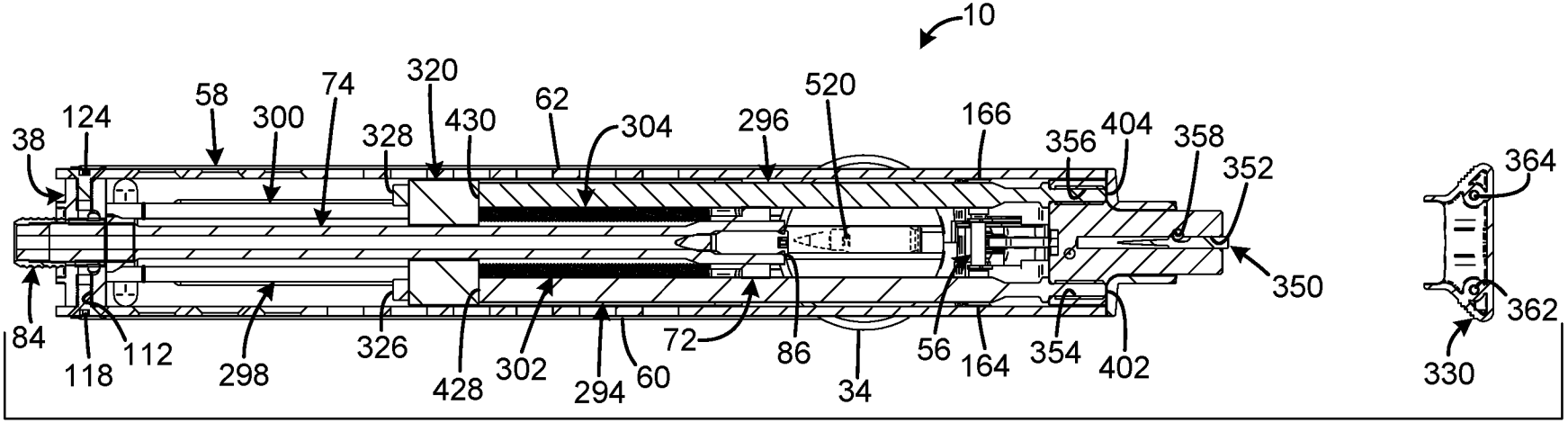
FIG. 12 is a bottom sectional view of the firearm of FIG. 1 in the full recoil condition.
Figure 13:
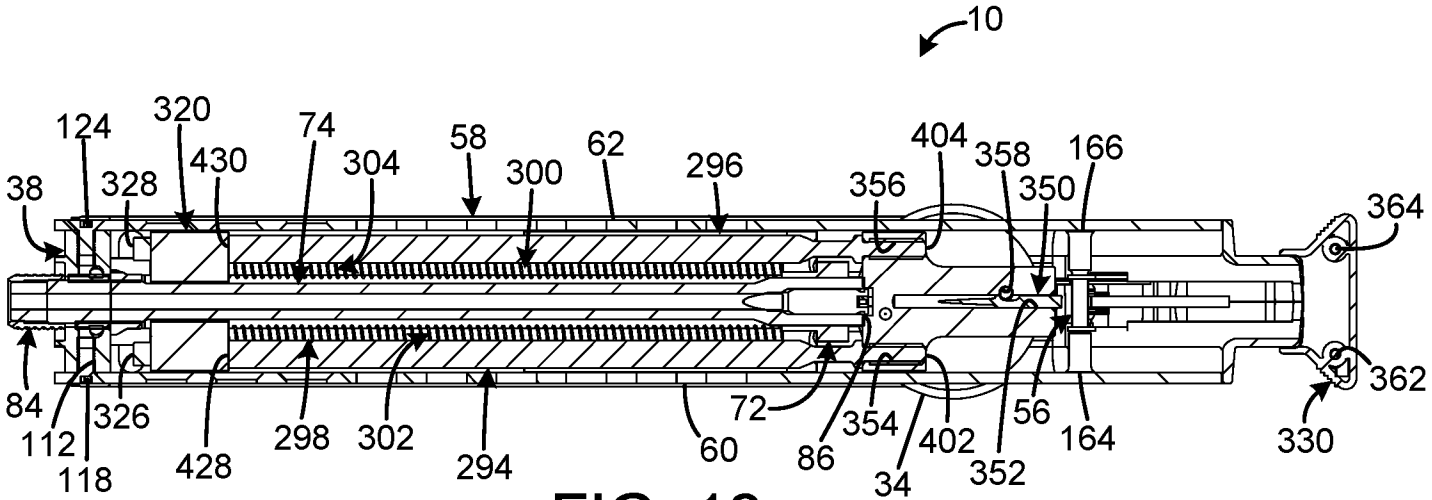
FIG. 13 is a bottom sectional view of the firearm of FIG. 1 in the battery condition.

FIGS. 8-13 illustrate the improved firearm 10 and the bolt assembly in the conditions of full recoil (FIGS. 8, 10, and 12) and in battery (FIGS. 9, 11, and 13). In FIG. 8, the interior 516 of the magazine 16 is visible. More particularly, the magazine can hold up to fifty cartridges 518 in the current embodiment. It should be appreciated that all the cartridges are positioned perpendicular to the barrel 74 except for the cartridge ready to be fed 520 when the firearm 10 is in the full recoil condition. The cartridge ready to be fed has been rotated 90° counterclockwise into feeding position by the circular feeder 34 of the magazine. In the full recoil condition, the bolt assembly 18, including the operating handle frame 336, is in the rearmost position. It should be appreciated that the bolt assembly can also be manually placed into the full recoil position by the user pulling on portion 522 of the operating handle latch 338 to disengage the handle latch from the receiver and then pulling rearwardly on the operating handle 330 to manually initiate cycling of the bolt 286 to chamber the cartridge ready to be fed. As the bolt assembly cycles forward to the in battery condition, the bolt strips the cartridge ready to be fed from the circular feeder and loads the cartridge ready to be fed into the chamber 86 of the barrel as shown in FIGS. 9 & 13. The firearm 10 is then ready to be fired once the trigger 284 is pulled. It should also be appreciated that the left and right recoil buffers 306, 308 limit and cushion the forward movement of the bolt 286 when the left and right recoil buffers impact the bolt rod mount 320.

Figure 14:
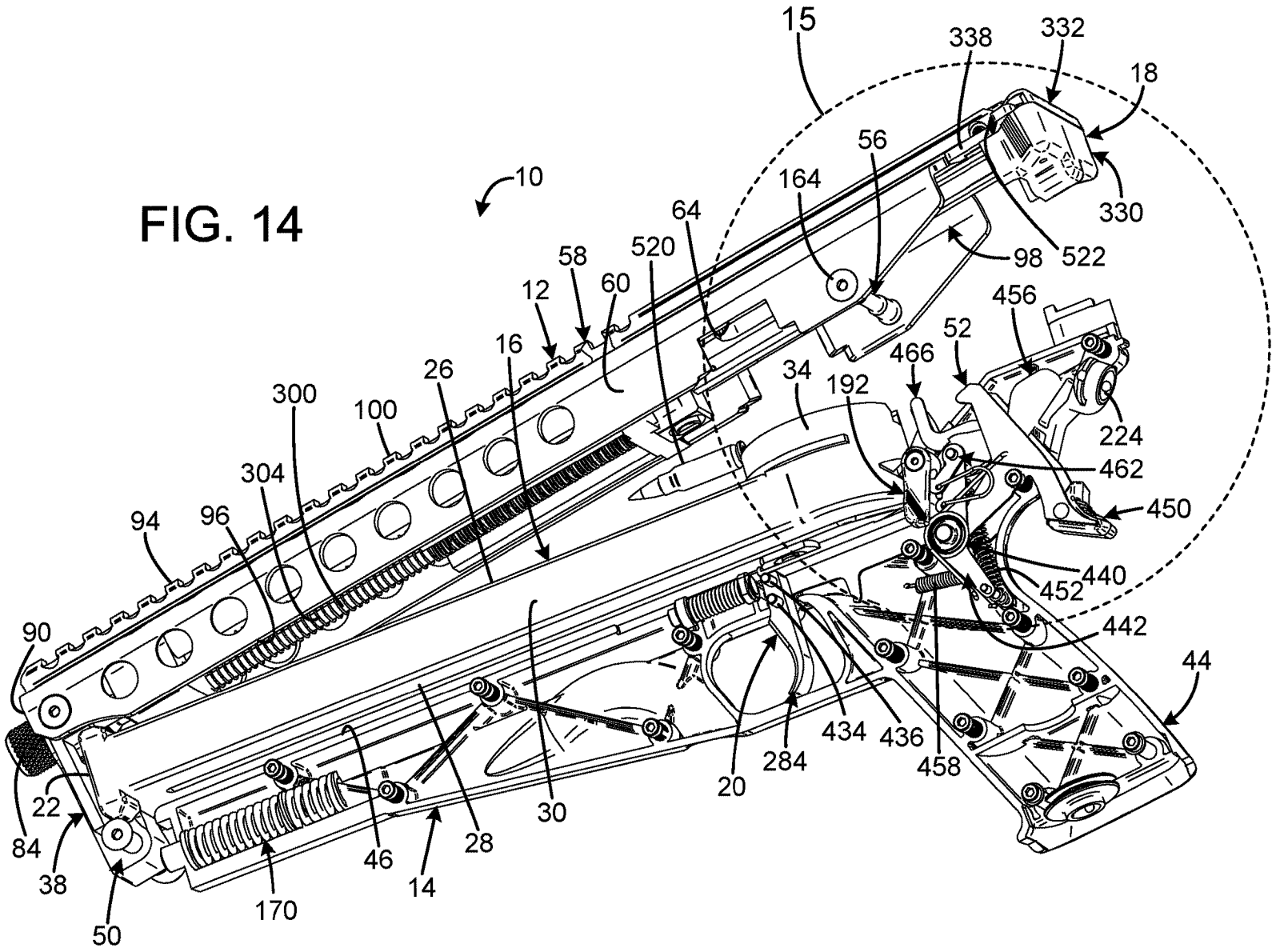
FIG. 14 is a bottom isometric view of the firearm of FIG. 1 in the partially open position with the left grip removed.
Figure 15:
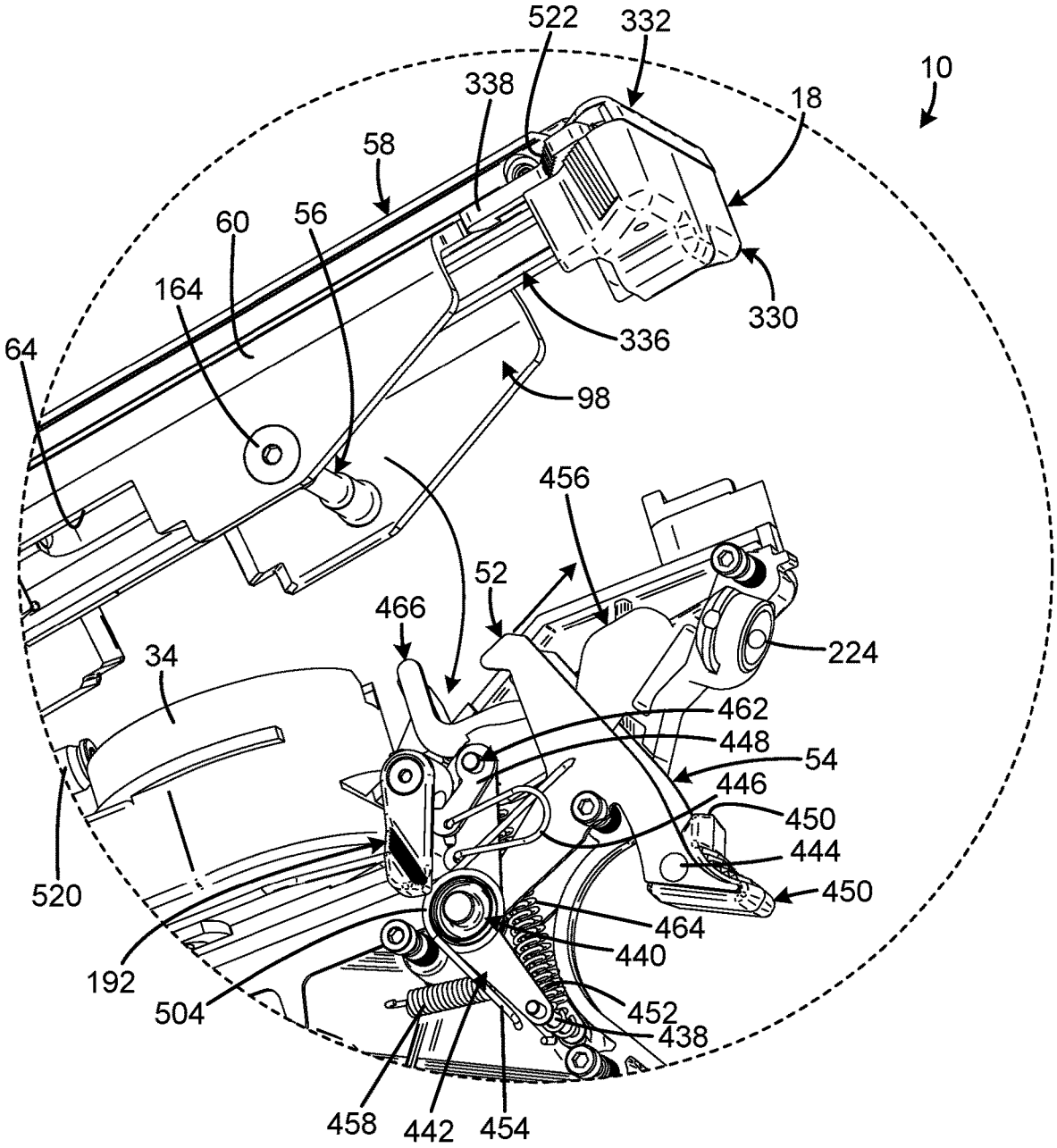
FIG. 15 is an enlarged view of the circled area 15 of FIG. 14.
Figure 16:
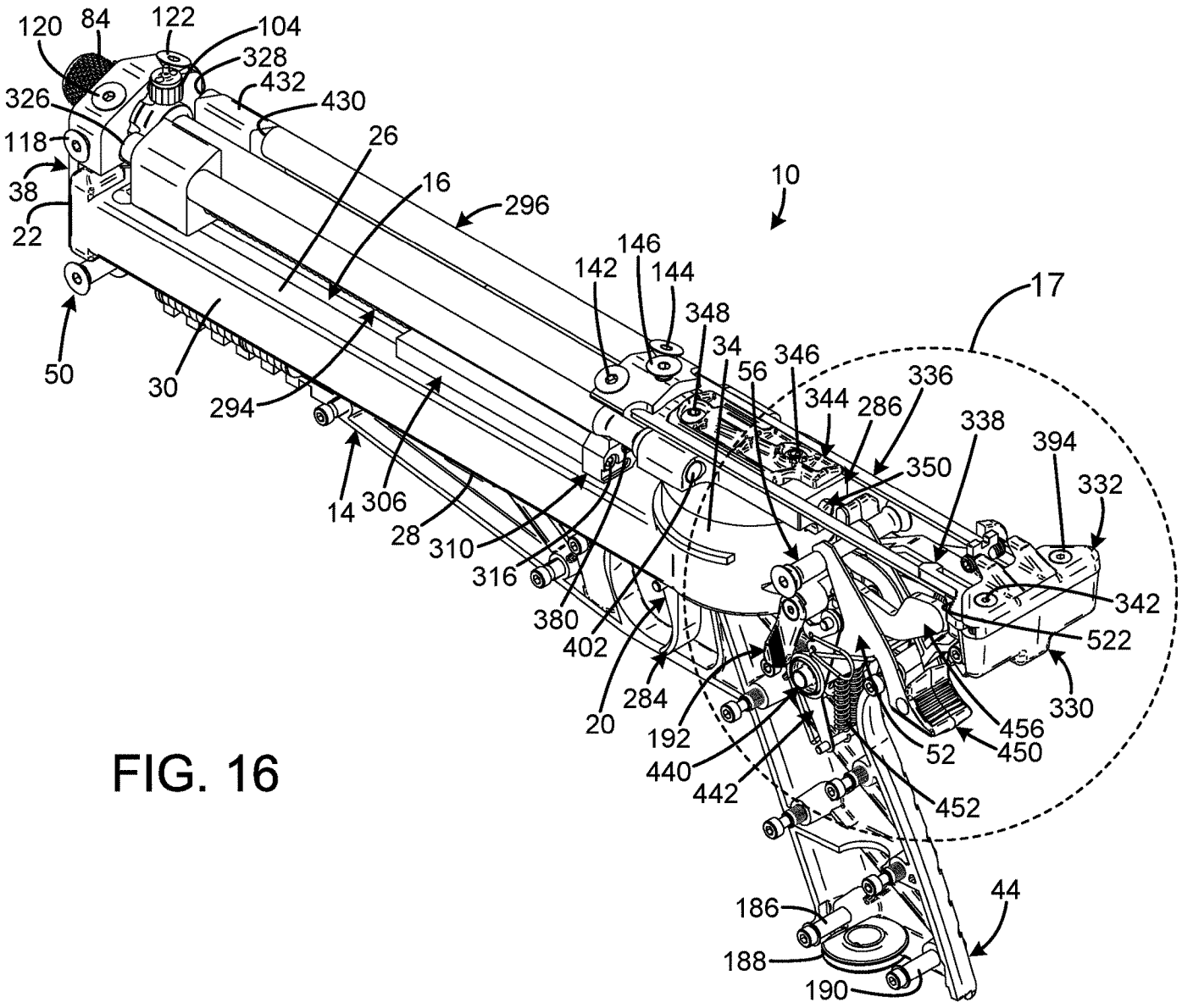
FIG. 16 is a top isometric view of the firearm of FIG. 1 in the closed position in the full recoil condition with the receiver and left grip removed.
Figure 17:
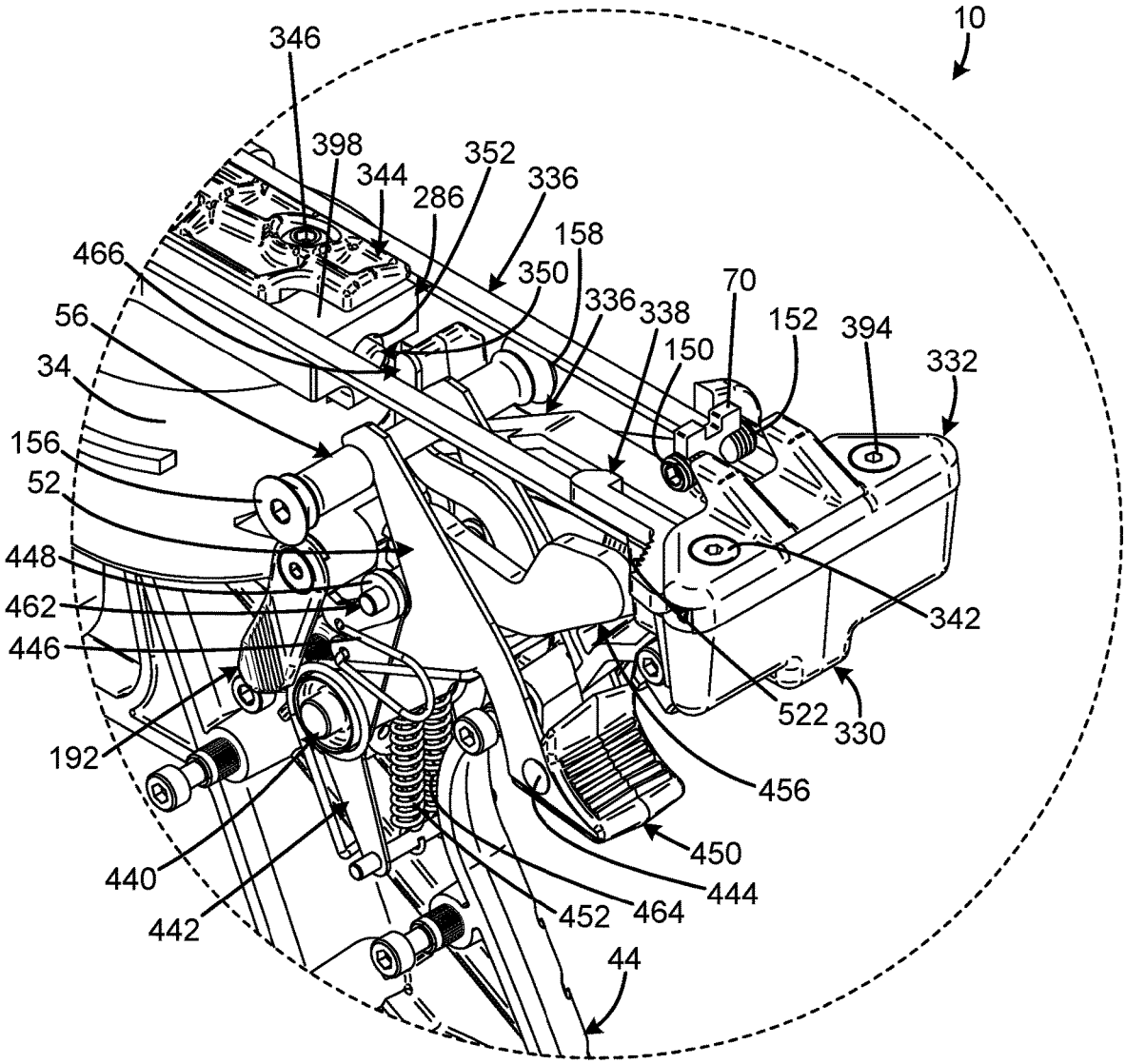
FIG. 17 is an enlarged view of the circled area 17 of FIG. 16.

FIGS. 14-17 illustrate the improved firearm 10. More particularly, FIGS. 14 & 15 show the firearm 10 in the partially open position with the left grip 42 removed to expose internal components. FIGS. 16 & 17 show the firearm 10 in the closed position in the full recoil condition with the receiver 58 and left grip removed to expose internal components. To transition the firearm 10 from the closed position through the partially open condition and subsequently to the fully open condition depicted in FIG. 3, the user depresses and holds the assembly button 450 against the biasing force of the release spring 454 to disengage the left and right release catches 52, 54 from the receiver release bar 56. The user is then able to lift the receiver assembly 12 by the operating handle 330 to pivot the muzzle block 38 counterclockwise about hinge 50. The pivoting movement of the receiver assembly is limited and cushioned by contact between the bottom 250 of the muzzle block and the front 524 of the buffer shaft 170. Once the release bar has cleared the left and right release catches, the user can release the assembly button, which is then returned to the at rest position by the release spring. To transition the firearm 10 from the fully open condition to the closed position, the user pushes down on the rear 92 of the receiver assembly to pivot the muzzle block clockwise about the hinge until sufficient force is applied to the left and right release catch to overcome the biasing force of the release spring and force the left and right release catches into engagement with the receiver release bar. At this point, the receiver assembly is secured against movement until the user again depresses and holds the assembly button against the biasing force of the release spring to disengage the left and right release catches from the receiver release bar.

While a current embodiment of a firearm has been described in detail, it should be apparent that modifications and variations thereto are possible, all of which fall within the true spirit and scope of the invention. For example, the magazine can have a capacity of 10 or 30 rounds in addition to the 50 rounds described. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a lower frame including a trigger and a grip;

an upper frame including a barrel and a bolt and configured for movement away from the lower frame; and a magazine receptacle configured to receive a magazine and positioned between the upper and lower frames.

2. The firearm of claim 1 wherein the lower frame and upper frame each have forward portions pivotally connected to each other to form a pivotal connection.

3. The firearm of claim 2 wherein the pivotal connection is operable to pivot on a horizontal axis transverse to the firearm.

4. The firearm of claim 1 wherein the upper and lower frames are movable between an open position in which the upper and lower frame are angularly separated from each other and the magazine receptacle is accessible for removal and replacement of a magazine, and a closed position in which the magazine is closely received between the upper and lower frames.

5. The firearm of claim 4 wherein the magazine receptacle is laterally open on both sides of the firearm, such that a major portion of lateral edges of the magazine is exposed when the frames are in the closed position.

6. The firearm of claim 4 wherein the magazine is an elongated body having major opposed upper and lower faces, and elongated side edges.

7. The firearm of claim 6 wherein the side edges are exposed when the frames are in the closed position.

8. The firearm of claim 6 wherein the magazine includes an ammunition exit facility at the upper surface and wherein the upper frame bolt is operable to strip a cartridge from the ammunition exit facility.

9. The firearm of claim 8 wherein the ammunition exit facility is at a rear end of the magazine.

10. The firearm of claim 1 wherein the barrel has a muzzle end proximate a forward end of the magazine receptacle.

11. The firearm of claim 1 wherein the upper and lower frames are pivotally connected on a hinge axis at a level below the magazine receptacle.

12. The firearm of claim 1 wherein the magazine receptacle has a rear end proximate the grip.

13. The firearm of claim 1 wherein the upper frame includes a forward barrier defining a forward portion of the magazine receptacle.

14. The firearm of claim 1 wherein the upper frame includes a reciprocating bolt assembly operable to move between a forward battery position and a rear retracted position, the bolt assembly having a forward portion forward of a breech end of the barrel when in the forward battery position.

15. The firearm of claim 14 wherein the forward portion of the bolt assembly is forward of a breech end of the barrel when the bolt assembly is in the retracted position.

16. The firearm of claim 14 wherein the bolt assembly has a center of mass forward of a breech end of the barrel when the bolt assembly is in the forward battery position.

17. The firearm of claim 14 wherein the bolt assembly has a forward portion proximate a muzzle end of the barrel when in the forward battery position.

18. The firearm of claim 14 wherein the bolt assembly has a rear portion rearward of the barrel and having a breech face, an elongated connector element having a rear end connected to the rear portion of the bolt assembly and an opposed forward end, and a forward weight connected to the forward end of the connector element.

19. The firearm of claim 18 wherein the forward weight defines a channel receiving the barrel and having opposed side portions on opposite lateral sides of the barrel.

20. The firearm of claim 1 wherein the upper frame and lower frame are movable with respect to each other between a closed position in which a magazine is secured in the magazine well and an open position in which insertion and removal of a magazine is enabled.

21. A firearm comprising:

a lower frame including a trigger and a grip;

an upper frame including a barrel and a bolt and configured for movement away from the lower frame; and a horizontal planar space defining a magazine receptacle configured to receive a magazine and positioned between the upper and lower frames.

22. A firearm comprising:

a lower frame including a trigger and a grip;

an upper frame including a barrel and a bolt;

a magazine receptacle configured to receive a magazine and positioned between the upper and lower frames; and the magazine receptacle being an elongated space enclosed at forward and rear ends.

23. A firearm comprising:

a lower frame including a trigger and a grip;

an upper frame including a barrel and a bolt;

a magazine receptacle configured to receive a magazine and positioned between the upper and lower frames; and the magazine receptacle being open above the lower frame to enable removal of the magazine in a vertically upward direction from the lower frame.

* * * * *